United States Patent [19]

Kurabayashi et al.

[11] Patent Number: 4,851,328

[45] Date of Patent: Jul. 25, 1989

[54] PHOTOSENSITIVE SHEET OF INSTANT FILM

[75] Inventors: Hiroyuki Kurabayashi; Minoru Ono, both of Kanagawa, Japan

[73] Assignee: Fuji Photo Film Co., Ltd., Kanagawa, Japan

[21] Appl. No.: 179,775

[22] Filed: Apr. 11, 1988

[30] Foreign Application Priority Data

Apr. 11, 1987 [JP] Japan ..... 62-89245

[51] Int. Cl.[4] ..... G03C 1/84; G03C 1/87

[52] U.S. Cl. ..... 430/536; 430/220; 430/227; 430/517; 430/538

[58] Field of Search ..... 430/227, 220, 538, 536, 430/517

[56] References Cited

U.S. PATENT DOCUMENTS

| | | | |
|---|---|---|---|
| 3,501,298 | 3/1970 | Crawford | 430/538 |
| 3,753,764 | 8/1973 | Haefner | 430/227 |
| 3,758,376 | 9/1973 | Beckner et al. | 430/538 |
| 4,312,937 | 1/1982 | Kasper et al. | 430/220 |

*Primary Examiner*—Richard L. Schilling

*Attorney, Agent, or Firm*—Sughrue, Mion, Zinn, Macpeak & Seas

[57] ABSTRACT

A peel-apart monochromatic instant film unit including two separate diffusion transfer sheets, namely, a negative or photosensitive in which a latent image is created as a result of exposure and a positive or image-receiving sheet where the positive image is formed. The photosensitive sheet has a carbon containing paper base support which is provided on its one side with a white paper layer, a titanium dioxide containing polyethylene layer and a photosensitive emulsion layer, in that order, and on the opposite side is optionally provided with a transparent polyethylene layer and a backing layer.

6 Claims, 2 Drawing Sheets

PHOTOSENSITIVE SHEET OF INSTANT FILM

FIELD OF THE INVENTION

The present invention relates to a photosensitive sheet used in a peel-apart type instant picture film, and more particularly to a monochromatic photosensitive sheet used in a peel-apart type instant picture film.

BACKGROUND OF THE INVENTION

In peel-apart type instant films (which are hereinafter referred as film units for simplicity). two separate diffusion transfer sheets are used in black-and-white or monochromatic photography: a negative or photosensitive sheet and an image receiving or print sheet where a positive image is formed.

For the purpose of providing a brief background that will enhance an understanding of the construction of the film unit in which the present invention is embodied, reference is now had to FIG. 1. The negative and positive sections of the film unit are on separate sheets: a negative or photosensitive sheet, and a positive or image-receiving sheet. In the photosensitive sheet 1, exposure creates a latent image. Connected to the photosensitive sheet 1 are a withdrawing sheet member 2 at its front margin (at the right-hand side of the photosensitive sheet in FIG. 1) and a rear flap member 3 at its rear margin. The withdrawing sheet member and flap member 3 are both made of black carbon containing paper sheet materials which have less surface reflection. The withdrawing sheet member 2 is provided with a rectangular tab 4 detachably connected thereto near its front section. The withdrawing sheet member 2 is further provided on its rear portion with a rupturable pod 5 containing a processing reagent or a liquid or viscous developer reagent therein, as well as a funnel member 2*a* which is adapted to cooperate with the rear portion of the withdrawal sheet member 2 so as to form a passage for the developer reagent released from the pod 5 for preventing it from escaping from the sides of the film unit.

A mask member 6, which is connected to the withdrawing sheet member 2 at its front end, is formed with an aperture 6*a* for defining an image receiving area 7*a* on the image receiving sheet 7 which is attached to the back of the mask member 6 in such a way as to cover the aperture 6*a*. Along each side of the aperture 6*a*, the mask member 6 is provided with a predetermined thickness of rail for effecting a uniform distribution of developer reagent. The mask member 6 has at its rear end a flap 6*b* which is adapted to face the rear flap member 3 at the end of the withdrawal of the film unit between a pair of pressure applying processing rollers of which operation and fabrication is well known to those skilled in the art and need not be explained in detail herein. To each rail member 5 on the flap 6*b* a spacer member 9 is adhered to provide a trapping space for developer reagent.

All of the members 2, 3 and 9, which are made of paper sheet materials are adhered to the photosensitive and/or image receiving sheets 1 and/or 7 through sealing material.

The film unit thus constructed is, after exposure, withdrawn from an instant camera or a camera back. At this time the two sheets 1 and 7 pass between the pair of juxtaposed pressure applying processing rollers thereby to be superimposed emulsion-to-emulsion and to break the pod so as to release the viscous developer reagent and spread it between the two superimposed sheets 1 and 7 in a thin uniform layer after having passed through the passage formed by the rear portion of the withdrawing member 2 and the funnel member 2*a*. The developer reagent thus spread between the two superimposed sheets 1 and 7 is maintained uniform in thickness by virtue of the spacer rails 8, so as to avoid unevenness in development over the image area. In a very few minutes, a positive image is formed on the image-receiving sheet by means of diffusion transfer.

As is shown in FIG. 2, the photosensitive sheet 1 generally consists of various materials in layers: a polyethylene (which is hereinafter abbreviated "PE") layer 25, a gray paper layer 26, a PE layer 27 and photosensitive emulsion layer 28. Additional details may be obtained by reference to U.S. Pat. No. 219,159.

The PE layer 25 which contains carbon is 10–48 $g/m^2$ in weight and serves as a black opaque layer. The paper layer 26 which contains carbon and titanium dioxide and is gray is 55–125 $g/m^2$ in weight and used as a paper base support. The carbon is added to connect fibers by filling the joints (pin holes). On the other hand, the titanium dioxide is added to compensate for a lack of whiteness, namely reflectance, of the PE layer 27 so as to improve the reflectance of the PE layer 27. The PE layer 27 which contains enough titanium dioxide to effect a masking of the carbon contained in the paper layer 26 and is white is 10–48 $g/m^2$ in weight.

In recent monochromatic instant film, fast films are required such as to have speed as or sensitivities rated 3000 or more in ISO (International Standardization Organization) speed number code. In an attempt at realizing such a fast instant film it will be effective to use exposing light sufficiently as well as to improve the emulsion layer. For best performance of exposing light, it is advantageous to return light passed through the emulsion layer 28 to the emulsion layer 28.

Exposing light can be reflected by the PE layer 27 with an increased reflectance and so as to be returned to the emulsion layer. Reflectance can be increased by adding a large amount of titanium dioxide in the PE layer 27. However, as is well known to those in the art, for preventing a PE layer of an instant film from being cracked when withdrawn from a camera or a camera back, the amount of added titanium dioxide is restricted up to approximately 17% in weight desirably to a practical range between 13 and 15% in weight. For this reason, the paper layer is needed to have an increased reflectance by virtue of an increased amount of titanium dioxide so as to reflect exposing light imaging onto the front surface thereof. However, because of a limited amount of additives of the paper layer, more titanium dioxide is increasingly added in the paper layer, lesser carbon can be containing. If the amount of carbon contained in the paper layer is in fact decreased, it becomes difficult to obtain an instant film with a sufficient light shielding effect.

OBJECTS OF THE INVENTION

It is, therefore, an object of the present invention to provide a photosensitive sheet of instant film which has an sufficient opacity and a high reflectance.

It is another object of the present invention to provide a photosensitive sheet which makes it possible to provide a fast or highly sensitive instant film.

SUMMARY OF THE INVENTION

The above objects of the present invention are achieved by providing a photosensitive sheet which includes a black paper layer having a high opacity, a white paper layer having a high reflectance laid over the black paper layer and a titanium oxide, preferably titanium dioxide containing PE layer having a photosensitive emulsion layer on one side which is laid over the white paper layer on the side opposite to the side having a photosensitive emulsion layer.

BRIEF DESCRIPTION OF THE DRAWINGS

The above and other objects and features are apparent from the following description taken in conjunction with a preferred embodiment thereof with reference to the accompanying drawings in which.

DETAILED DESCRIPTION OF THE INVENTION

Figure 3:
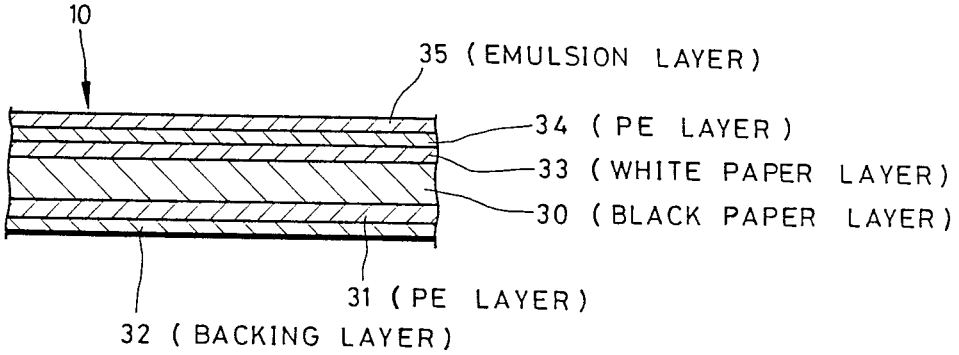
FIG. 3 is a cross sectional view similar to FIG. 2, showing a photosensitive sheet of a peel-apart type instant film unit according to the present invention.

Referring now to FIG. 3 there is shown a construction of the photosensitive sheet according to the present invention. As shown, the photosensitive sheet has a carbon containing black paper layer 30 as a film support which is about 25–125 g/m$^2$ for perfectly blocking light passing through a transparent PE layer 31, which will be described in later. The PE layer 31 which is 10 –48 g/m$^2$ is laid over and protects the under surface of the paper layer 30. Laid over the under surface of the transparent PE layer is a backing layer 32 of about 3–5$\mu$ for preventing a photosensitive sheet 10 from curling.

Figure 1:
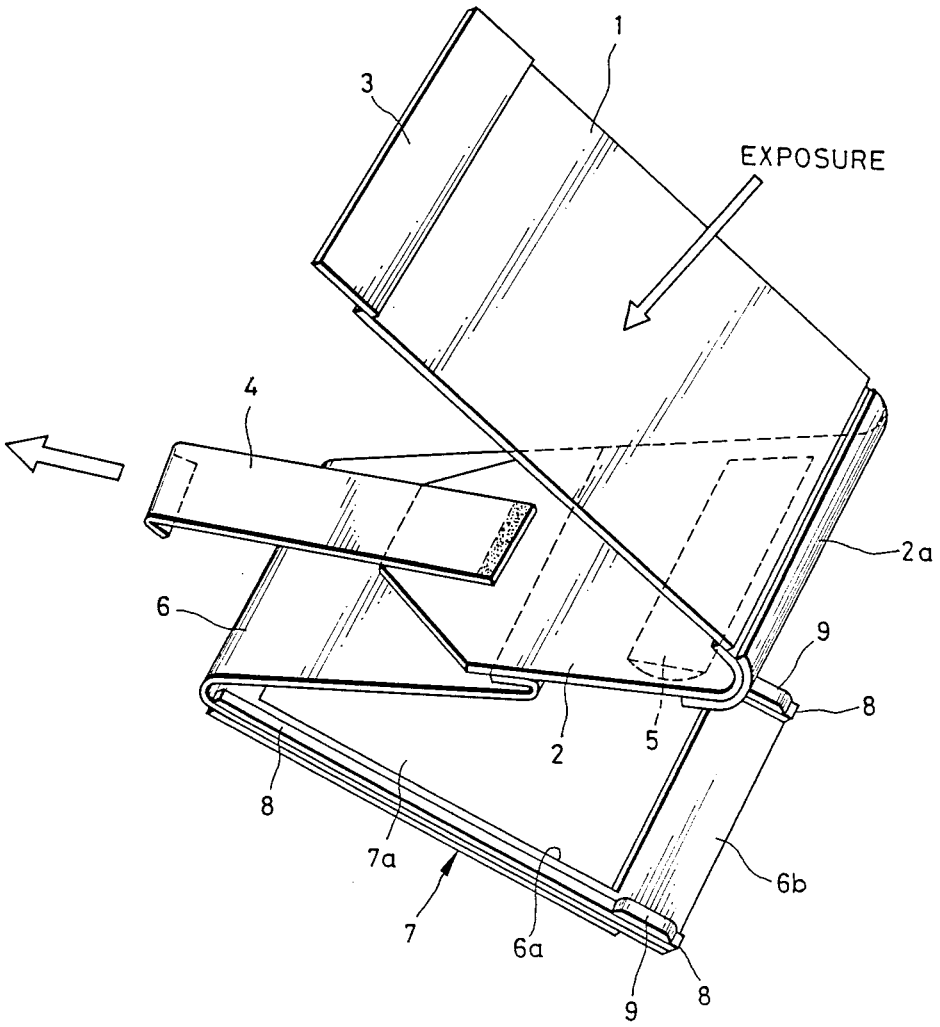
FIG. 1 is a schematic perspective view of a peel-apart type instant film unit.
Figure 2:
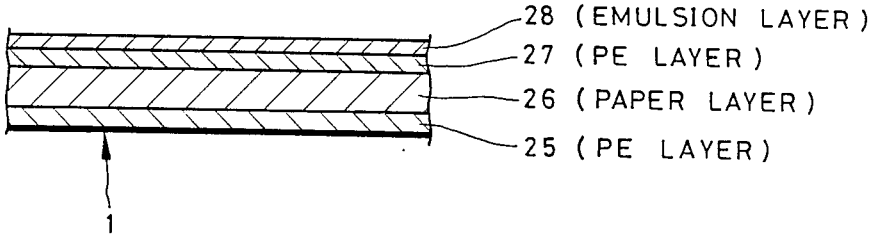
FIG. 2 PRIOR ART
FIG. 2 is a cross sectional view showing a photosensitive sheet of a conventional peel-apart type instance film unit.

Over the upper surface of the black paper layer 30 there is a white paper layer 33 of about 40–125 g/m$^2$ which has a reflectance of more than about 60% of incident light and an even smooth upper surface. Owing to the provision of the white paper layer 33 the internal reflectance of the photosensitive film 10 is considerably improved in comparison with the conventional photosensitive sheet 1 shown in FIG. 2 and reflects about 80–85% of the light passed through the PE layer 34. There are also the same titanium dioxide containing PE layer 34 and photosensitive emulsion layer 35 as in the known photosensitive sheet 1 provided in layers. There is titanium dioxide in titanium oxide, which is preferable to increase whiteness.

In the photosensitive sheet 10 described by way of example, although the white paper layer 33 is laid over the black paper layer 30, these layers 30 and 33 may be integrally formed into a single layer either by being combined during paper manufacturing or by being bonded to each other with transparent adhesives.

The present invention has been described with particular reference to a preferred and illustrative embodiment thereof, but it will be understood that variations and modifications can be effected within the scope of the invention.

What is claimed is:

1. A photographic sheet of a peel-apart type instant film comprising:

a paper base support comprising a black paper;

a white paper layer laid over said paper base support; and a titanium oxide containing polyethylene layer laid over said white paper layer, the titanium oxide containing polyethylene layer having a photosensitive emulsion layer on the side opposite to the side facing the white paper layer.

2. A photosensitive layer a defined in claim 1, wherein said paper base support is made of a carbon-containing paper.

3. A photosensitive sheet as defined in claim 1 wherein said titamium oxide is titanium dioxide.

4. A photosensitive sheet as defined in claim 1, wherein said paper base support and said white paper layer are bonded to each other in tight contact.

5. A photosensitive sheet as defined in claim 1, further comprising a transparent polyethylene layer provided on the under surface of said paper base support.

6. A photosensitive sheet as defined in claim 5, further comprising a backing layer laid over an under surface of said transparent polyethylene layer for preventing curling of said photosensitive sheet.

* * * * *